US011104406B2

(12) United States Patent
Barone et al.

(10) Patent No.: US 11,104,406 B2
(45) Date of Patent: Aug. 31, 2021

(54) UNDERWATER MASK WITH FEEDING AND DISCHARGE SYSTEM FOR BREATHING AIR

(71) Applicant: Mares S.p.A., Rapallo (IT)

(72) Inventors: Aristide Barone, Rapallo (IT); Marco Barbagelata, Genoa (IT); Valerio Palmieri, Rapallo (IT)

( * ) Notice: Subject to any disclaimer, the term of this patent is extended or adjusted under 35 U.S.C. 154(b) by 286 days.

(21) Appl. No.: 16/232,004

(22) Filed: Dec. 25, 2018

(65) Prior Publication Data

US 2019/0225311 A1 Jul. 25, 2019

(30) Foreign Application Priority Data

Jan. 25, 2018 (IT) ..... 102018000001849

(51) Int. Cl.
*B63C 11/16* (2006.01)
*B63C 11/12* (2006.01)

(52) U.S. Cl.
CPC ..... *B63C 11/16* (2013.01); *B63C 2011/128* (2013.01); *B63C 2011/165* (2013.01)

(58) Field of Classification Search
CPC ..... B63C 11/186; B63C 11/16; B63C 11/205; B63C 11/20; B63C 11/207; B63C 11/22; B63C 11/12; B63C 2011/165; B63C 2011/128; B63C 2011/121; B63C 2011/123; B63C 2011/125;
(Continued)

(56) References Cited

U.S. PATENT DOCUMENTS 7,261,104 B2 * 8/2007 Kiefer ..... A62B 9/04 128/201.17
10,807,687 B2 * 10/2020 Xiao ..... B63C 11/16
(Continued)

FOREIGN PATENT DOCUMENTS

CN 205469729 8/2016
CN 106428476 2/2017
(Continued)

OTHER PUBLICATIONS

Italian Ministry of Economic Development, Search Report (by the European Patent Office, dated Aug. 17, 2018).

*Primary Examiner* — Justine R Yu
*Assistant Examiner* — Kelsey E Baller
(74) *Attorney, Agent, or Firm* — Themis Law

(57) ABSTRACT

An underwater mask includes a frame, a transparent part, a seal part mounted on the frame, and a snorkel. The seal part has a partition wall forming an upper and a lower chamber, the lower chamber receiving nose and mouth of the user. The two chambers communicate through a passage in the partition wall and a one-way valve so that air can pass only from the upper chamber to the lower chamber. The snorkel has first and second channels through which the upper and respectively lower chamber communicate with the outside. A connection end between snorkel and mask is fastened at an opening of the seal part to put the first channel of the snorkel in communication with the upper chamber of the mask, and further has a side inlet for a corresponding exhaust tube that puts the lower chamber in communication with the second channel of the snorkel.

19 Claims, 12 Drawing Sheets

(58) Field of Classification Search
CPC . B63C 2011/126; B63C 11/18; B63C 11/202; B63C 2011/182
USPC ..... 128/201.11
See application file for complete search history.

(56) References Cited

U.S. PATENT DOCUMENTS

| | | | | |
|---|---|---|---|---|
| 2014/0331997 | A1* | 11/2014 | Weigner | B63C 11/205 128/201.11 |
| 2016/0297505 | A1* | 10/2016 | Caprice | B63C 11/16 |
| 2017/0096204 | A1* | 4/2017 | Cucchia | B63C 11/16 |
| 2018/0065719 | A1* | 3/2018 | Liao | B63C 11/16 |
| 2018/0319471 | A1* | 11/2018 | Thomas | B63C 11/205 |
| 2019/0002068 | A1* | 1/2019 | Godoy | B63C 11/205 |
| 2020/0115015 | A1* | 4/2020 | Sang | B63C 11/205 |
| 2020/0130792 | A1* | 4/2020 | Huang | B63C 11/16 |
| 2020/0189700 | A1* | 6/2020 | Vaccaro | B63C 11/16 |

FOREIGN PATENT DOCUMENTS

| | | |
|---|---|---|
| CN | 206141801 | 5/2017 |
| CN | 206407093 | 8/2017 |
| EP | 3153400 | 4/2017 |
| WO | 2015170013 | 11/2015 |

* cited by examiner

UNDERWATER MASK WITH FEEDING AND DISCHARGE SYSTEM FOR BREATHING AIR

FIELD OF THE INVENTION

The present invention relates to the field of diving masks, in particular for the so called "snorkeling" activity i.e. the practice of observing the marine environment while swimming on the surface with the head underwater.

BACKGROUND OF THE INVENTION

Generally, this kind of activity requires a mask provided with a transparent element to watch and a mouthpiece to breath. A mouthpiece is a tube having a free upper end adapted to be arranged out of the water and a lower end provided with a shaped member that the user places into the mouth in order to inhale and exhale air.

Since mouth breathing is not natural and the transparent element of the mask is prone to get fogged, masks with integral mouthpiece have been introduced that allow the nose to be also used for breathing.

Document WO2015/170013 describes such a mask comprising a frame fastening a transparent portion to a seal portion adapted to be positioned on the diver's face. The seal portion has a partition wall adapted to be rested on the user's nose, when the mask is worn, so as to form an upper chamber and a lower chamber, the lower chamber accommodating the nose and the mouth of the user. The two chambers communicate through a passage provided in the partition wall and through a one-way valve so that the air can flow from the upper chamber to the lower chamber and not vice versa.

The mask comprises a snorkel ("ventilation tube") divided in three dedicated non-communicating channels, the first central one, at the air inlet and the other two, which are lateral, at the air outlet. The snorkel is fitted in an upper opening of the frame such to put the central channel directly in communication with the upper chamber and the side channels with the lower chamber by means of a couple of ducts obtained in the frame. This way the air inhaled reaches the nose and mouth of the user by passing through the snorkel to the lower chamber by means of the upper chamber of the mask whereas the exhaled air is directly conveyed from the lower chamber to the snorkel in order to be ejected.

Although performing its main function pretty well, this mask has some drawbacks. Firstly, the snorkel is prone to break if the user does not care to pull it off when he/she is not using the mask, for example during transport. Secondly, a small breaking in the frame, is enough to make the mask useless as this can cause the outflow of exhaled air inside the upper chamber. In addition, the transparent element, typically glass, has a considerable size when compared to traditional masks as it covers the whole user's face whereby it is more easily prone to accidental breakings.

SUMMARY OF THE INVENTION

It is an object of the present invention to solve, at least partly, the aforesaid drawbacks.

The invention achieves its object with a mask comprising a frame, a transparent part supported by the frame, a seal part mounted on the frame and intended to be placed on a user face and a snorkel. The seal part comprises a partition wall intended to rest on the user's nose, with the mask in the worn condition, such to form an upper chamber and a lower chamber, with the lower chamber receiving the nose and mouth of the user. The two chambers communicate only through at least one passage provided in the partition wall and through a one-way, non-return valve that opens and closes said passage such that air can pass from the upper chamber to the lower chamber and not vice versa. The snorkel, comprising at least one first and one second channel that put the upper chamber and the lower chamber in communication with the external environment respectively, cooperates with a connection end integral to the mask. The connection end is fastened or fastenable at an opening of the seal part that puts the first channel of the snorkel in communication with the upper chamber of the mask and has an inlet connecting to an exhaust tube that puts the lower chamber in communication with the second channel of the snorkel, for exhausting the exhaled air.

This allows strength and safety of the mask to be increased, since possible breakings of the frame upon accidental impacts do not make the mask useless, since the exhaled air is conveyed towards the snorkel through one, preferably two, exhaust tubes that are not integrated in the frame of the mask itself and further made of relatively soft and elastically deformable plastic material, such as for example the same material as the seal part of the mask.

Advantageously, the duct or ducts for the exhaled air run, in fact, externally to the mask in proximity of the edge of the seal part.

A very compact solution is also possible, according to which the duct or ducts for the exhaled air run internally to the mask and sealingly cross one or two holes provided in the partition wall of the seal part.

According to a first embodiment, the exhaust tube or the two exhaust tubes are made firmly fastened to the seal part at a passage opening in communication with the lower chamber.

A variation of this embodiment provides for the exhaust tube or tubes being made in one piece and possibly of the same material as the seal part.

A further embodiment variation provides instead that the exhaust tube or tubes are sealingly fastenable to the seal part at a corresponding opening in communication with the lower chamber.

In this embodiment variation the end of each exhaust tube can be provided with a connection end connecting to the corresponding communication opening in any way, for example by interlocking coupling and/or shape coupling and/or elastic forcing on a cooperating connection to the seal part.

According to still a further embodiment variation an element is provided sealingly and removably fastening the end of an exhaust tube to the communication opening of the seal part, which element is a separate constructional part intended to be interposed between said end of an exhaust tube and the corresponding communication opening, while said fastening element has members firmly and/or releasably fastening, on one side, to corresponding members on the end of the exhaust tube, and on the other side, to the wall delimiting said opening.

A further embodiment can provide that at the communication opening a non-return valve is provided oriented such to allow the flow from the lower chamber to the exhaust tube and to prevent the flow in the opposite direction.

Such a characteristic can be provided for any of the two embodiments and the several embodiment variations afore described and pertaining the alternatives for connecting the exhaust tube or tubes to the communication opening in the seal part.

Such a characteristic can also be provided in combination with any embodiment of the exhaust tubes and also in combination with an embodiment of the exhaust tube or tubes, for example according to document WO2015/170013.

An embodiment variation of the non-return valve provides that the same is integrated in the coupling end of the end of an exhaust tube at the corresponding opening in communication with the lower chamber.

In an embodiment the non-return valve has a diaphragm plug made in one piece with the seal part and held in a place perpendicular to the axis or the passage direction in the port of the communication opening by material bridges, while the fastening members consist of members sealingly clamping a annular valve seat and an annular abutment wall that overlap the opposite faces of the wall strip surrounding said communication opening and also a peripheral strip of the diaphragm plug.

According to still a further characteristic, the ends coupling an exhaust tube to a corresponding communication opening are provided with anti-rotation counterchecks of said exhaust tube with respect to the communication opening around the axis thereof.

Still according to a further embodiment, which can be provided in combination with one or more of the preceding embodiments, at least along part of the side branches of the frame and the seal part, said frame and said seal part form a channel with a substantially V shaped cross section, with the closed vertex facing the central region of the mask, while the exhaust tube has a V shaped section shaped and sized correspondingly to the section and size of said channel, said exhaust tube being housed in said channel in the mounted condition and a wall thereof, on the side opposite to the central region of the mask, thus forming a wall connecting the surface of the frame and the seal part on the same side opposite the central region of the mask.

In all the depicted embodiments, the end of each exhaust tube opposite the one for fastening the seal part has an end for coupling to the corresponding connecting inlet.

In an embodiment, the snorkel or an end connecting said snorkel to the mask have an inlet connecting the exhaust tube to an exhaust channel or duct provided in said snorkel and/or in said connection end, which consists of a side branch union on which the end of the corresponding exhaust tube is fitted sealingly and by elastic forcing, possibly by interposing one or more seal parts, said branch union being oriented correspondingly to an extension of said exhaust tube towards the snorkel and/or the connection end.

Specifically, said side branch union or unions are provided externally to the rigid frame of the mask, directly adjacent to the same.

Still according to a further characteristic, the upper arch of the rigid frame of the mask has a union or an opening connecting to a union fastening the snorkel and connecting to the exhaust tube or tubes, which comprises a coupling end on its side for coupling to said union or said opening in the upper arch of the frame, and which coupling end is in communication with an air supply duct, while on a side or both sides of said supply duct an exhaust duct is provided, this or these exhaust duct or ducts and the air supply duct being parallel to one another, and while the exhaust duct or ducts in said fastening union of the snorkel have a side branch for the coupling to a corresponding exhaust tube, respectively, the two or three ducts, one of which being at least a venting one and at least an exhaust one, ending in a sealingly coupling end of a snorkel provided with a corresponding number of ducts.

Further characteristics and improvements are described hereinafter.

BRIEF DESCRIPTION OF THE DRAWINGS

The characteristics of the invention and the advantages deriving therefrom will be much clearer from the following specification of the accompanying figures, wherein.

DETAILED DESCRIPTION OF EMBODIMENTS OF THE INVENTION

Figure 1:
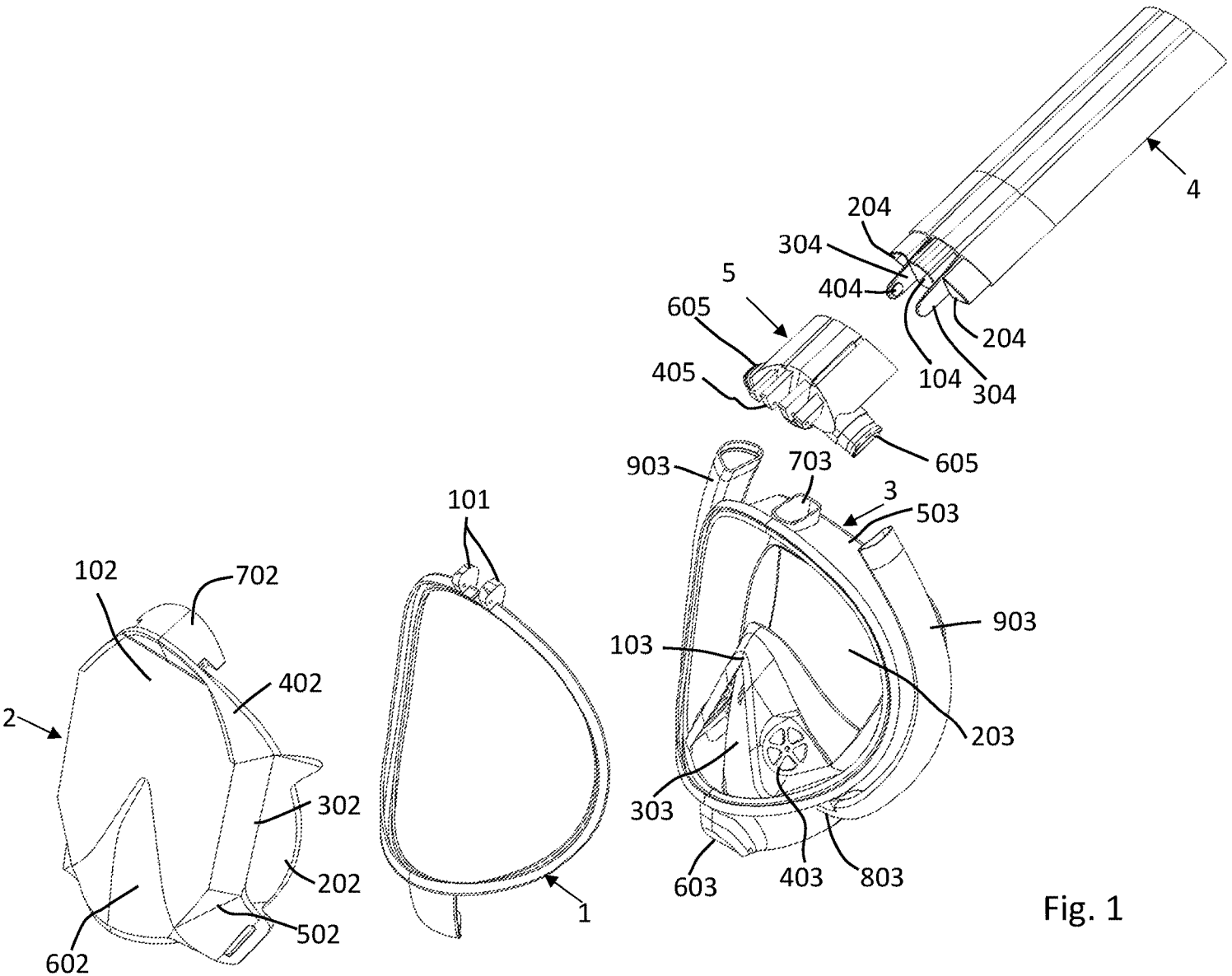
FIG. 1 shows an exploded front view of a mask according to an embodiment of the invention.
Figure 2:
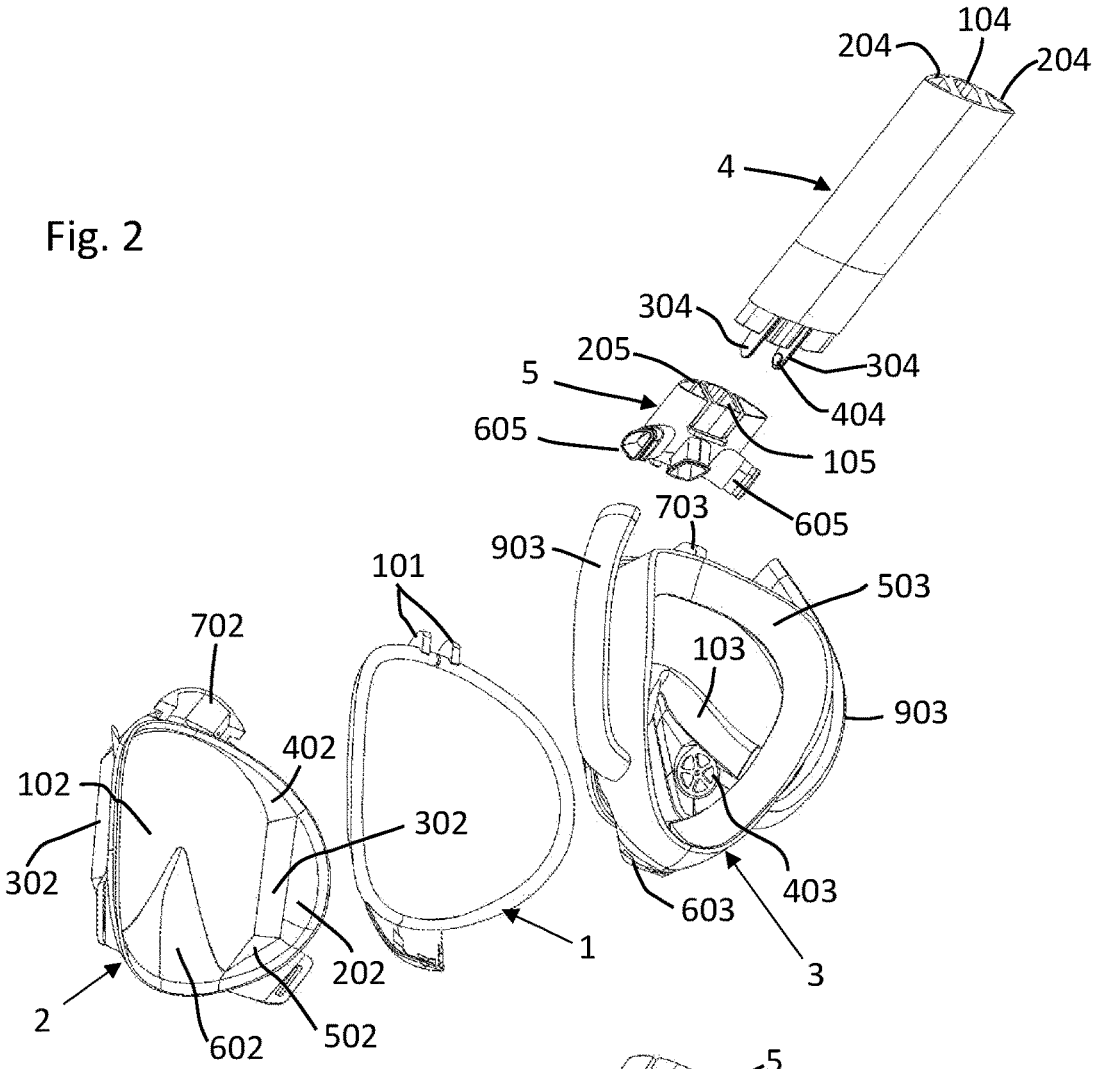
FIG. 2 shows an exploded end view of the same mask of the preceding figure.
Figure 3:
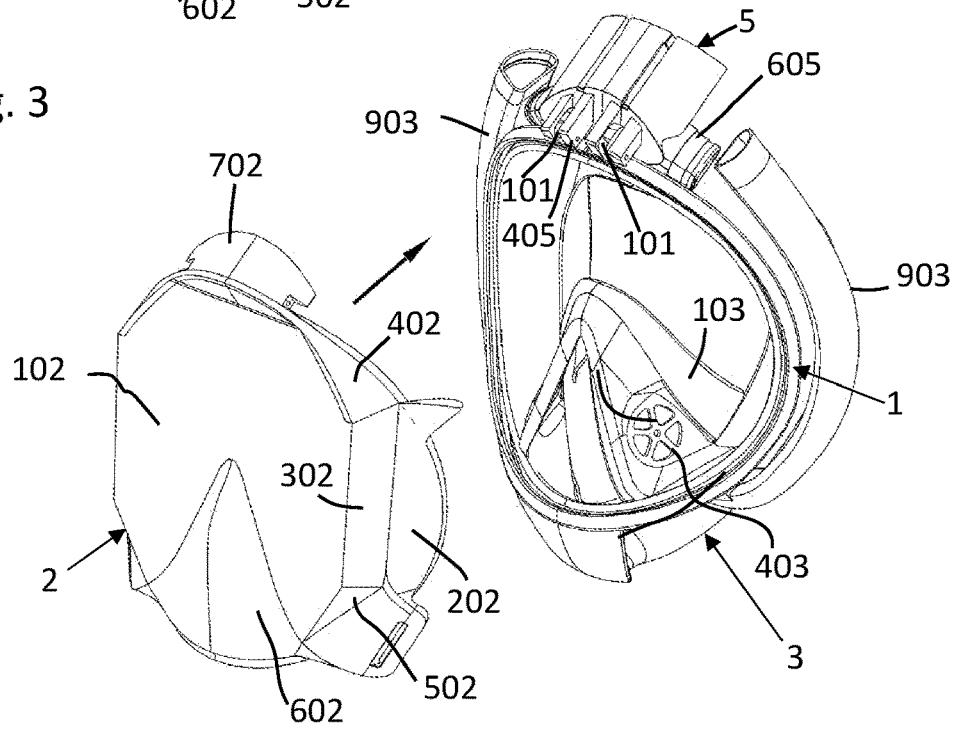
FIG. 3 shows the coupling of the transparent element to the frame of the mask.

With reference to FIG. 1, the mask according to an embodiment comprises a frame 1 having a generally elongated shape, for example oval or the like, which fastens a transparent part 2 to a seal part 3 adapted to be sealingly placed on and against the diver's face.

The seal part 3, made of rubber or other flexible material such as for example neoprene, has a partition wall 103 adapted to rest on the user's nose, with the mask in the worn condition, such to form an upper chamber 203 and a lower chamber 303, the lower chamber 303 accommodating the nose and the mouth whereas the upper chamber 203 the eyes of the user.

The two chambers are in communication through a passage provided in the partition wall 103 wherein a one-way, in particular non-return, valve 403 is housed and oriented such that air can flow from the upper chamber 203 to the lower chamber 303 and not vice versa. In the embodiment shown, the valves 403, and the respective passages, are two arranged on opposite sides of the partition wall 103 with respect to a median longitudinal line, i.e. the sagittal plane of the user's head.

The mask comprises a snorkel 4 that puts the upper chamber 203 and the lower chamber 303 in communication with the outer environment and that will be described in detail hereinafter.

The transparent part 2, made of glass or plastic material, is the visor of the mask through which the user is able to see to explore the marine environment. In its simplest configuration, the transparent element has a smooth convex surface having a peripheral edge which follows the profile of the frame 1 to be fitted in a throat thereof. The coupling is of the type adapted to make a seal and can provide that the edge of the transparent element is provided with a flange forming a protruding edge adapted to be engaged into an undercut compartment of the throat provided in the frame 1.

The coupling can also take place by snap-fit or shape coupling as in the mask described in document WO2015/170013.

In the embodiment shown in the figures, the transparent element 2 has a polygonal shape with squared connecting faces very shock- and scratch-resistant, affording a vision similar or even better than that of traditional masks.

Specifically, the transparent element 2, typically die molded, is divided into a central raised part 102, having planar development and polygonal shape, which is connected to the perimetrical region 202 adapted to be coupled to the frame 1, by the tilted polygonal shaped surfaces 302, 402, 502.

Underneath the central part 102 there is, at the partition wall 103 of the seal part 3, when the mask is assembled, a raised region 602 having polyhedral shape. Such raised region 602, advantageously consisting of plane surfaces having triangular shape and reciprocally connected and with the remaining of the transparent element 2, frontally delimits the lower chamber 303 and is intended to receive the user's nose.

The seal part 3, having an elongated configuration following the profile of the frame 1 and, more generally, the user's face, has a perimetrical edge 503 with four openings. The first one, positioned at the zone adapted to be arranged near the user's mouth, accommodates a purge valve 603 to eject possible water that can enter the mask.

The second opening 703 is arranged on the top of the perimetrical edge to receive air to convey into the upper chamber 203 from the snorkel 4.

The other two openings 803 are positioned on opposite sides of the perimetrical edge 503 and lead to the lower chamber so as to receive exhaled air that is conveyed towards the snorkel 4 by means of a couple of exhaust tubes 903 arranged on the perimetrical edge 503 and adjacent thereto, as shown in the figures.

For this purpose, the snorkel 4 is divided in three dedicated non-communicating channels, the first central one 104 at the air inlet and the other two 204, which are lateral, at the air outlet. The snorkel 4 engages into the upper opening of the frame 703 such to put the central channel 104 directly in communication with the upper chamber 203 and the side channels 204 with the lower chamber 303 by means of the couple of exhaust tubes 903. This way the inhaled air reaches the nose and the mouth of the user by flowing through the snorkel 4 to the lower chamber 303 by means of the upper chamber 203 of the mask, whereas the exhaled air is directly conveyed from the lower chamber 303 to the snorkel 4, in the side channels 204 to be ejected.

As better shown in FIGS. 4 to 11, the snorkel 4 has a connection end 5 between snorkel and mask, which connection end is intended to remain fastened to the mask and is connected to the snorkel 4 by means of an articulation having a coupling position in which the connection end 5 and the snorkel 4 are fastened in operating position and a releasing position of the snorkel 4 from the connection end 5 in which the snorkel 4 remains however connected to the connection end 5, but it is free to swing. In the embodiment depicted, the swing of the snorkel 4 with respect to the connection end 5, and thus the mask, takes place along an axis perpendicular to the axis of the snorkel and oriented along a frontal slice plane of the head wherein the term frontal plane refers to the definition of the slice planes of the human body used in medicine.

An alternative definition of the direction of the swing axis refers to the plane central portion 102 of the frontal element 2, such a swing axis being contained in a plane parallel to said plane portion 102 of the frontal element.

When the transparent element is curved, the aforesaid definition can be extended to the plane tangential to said curved surface which, in addition, is perpendicular to the plane passing by the central axis of the snorkel 4.

The connection end 5 consists of a central duct 105 and two side ducts 205 in which corresponding extensions of the central channel 104 and side channels 204 of the snorkel 4 are engaged, at an end.

The opposite end of the connection end 5 is closed and has tabs 405 for the engagement with corresponding tabs 101 that are on the frame 1, which are kept in position by a hooking surface 702 that is on the transparent element 2 when the mask is assembled.

The central duct 305 of the connection end 5, at the end opposite to the snorkel 4, has an opening below which engages in the hole 703 on top of the perimetrical edge 503, whereas each one of the two side ducts 205 leads to a corresponding connecting side branch 605 in which the corresponding exhaust tube 903 is engaged, the seal being generated by one or more seal parts 705.

Between the central duct 105 and the two side ducts 205 there is a gap 305 intended to accommodate corresponding tabs 304 that are on the snorkel 4, such to form simultaneously a sliding guide and a joint. The tabs 304 are flattened appendices having a protuberance with button configuration 404 on the side facing the inside.

Figure 6:
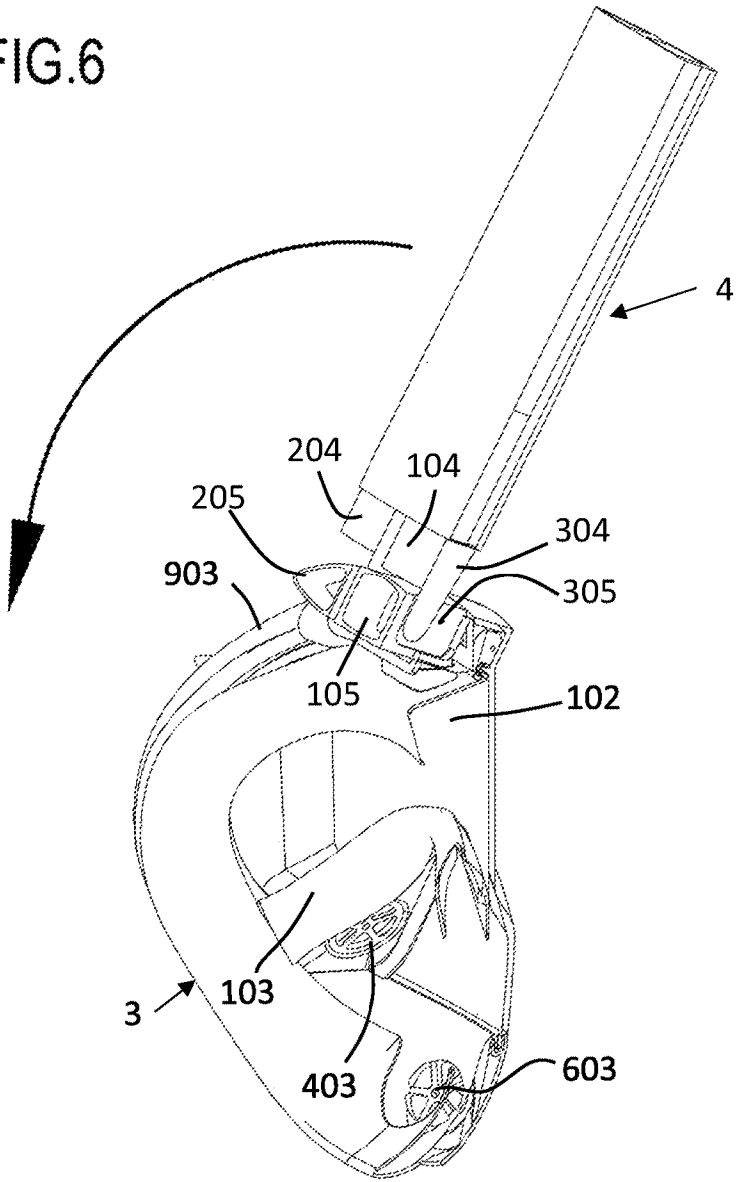
FIG. 6 shows the snorkel in the inserted position.
Figure 9:
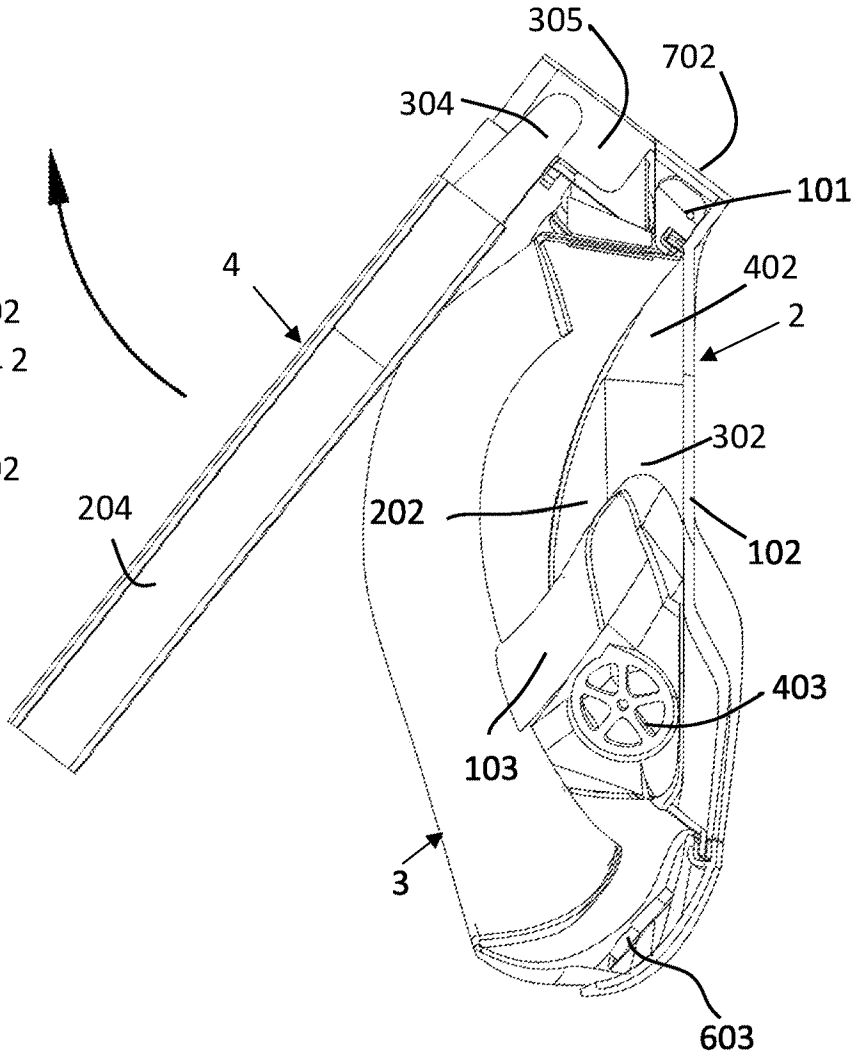
FIG. 9 shows a side section of the mask, with the snorkel in folded position.

As shown in FIG. 6, the gap 305 between the central duct 105 and each side duct 205 of the connection end 5 has a rectangular section following the side profile of the central duct 105 with the longest sides facing upwards and downwards, respectively, when the mask is in vertical position.

There is a perimetrical raised edge 505 on the shortest sides and the longest side facing downwards, acting like a cam path for the button 404 of the tabs 304.

Figure 5:
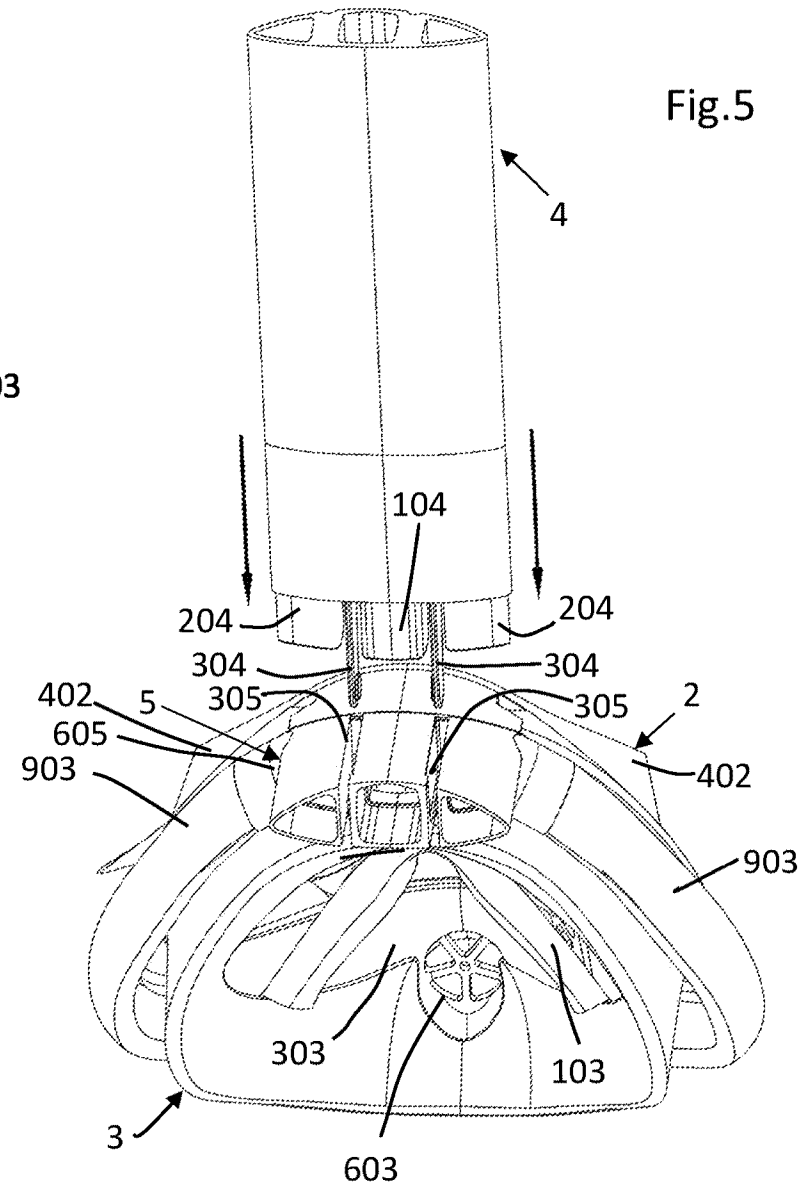
FIG. 5 shows the snorkel engaged on the connection end.
Figure 4:
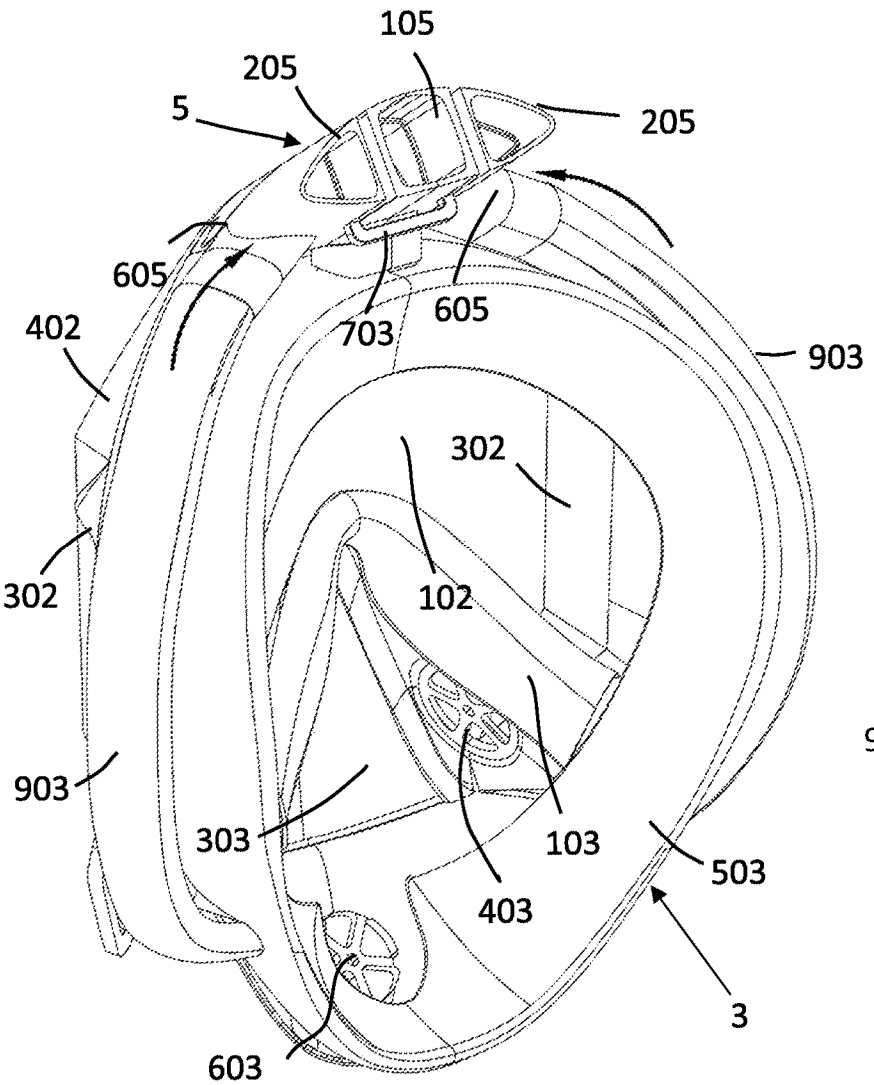
FIG. 4 shows an axonometric end view of the assembled mask with the ducts highlighted connecting the lower chamber to the connection end of the snorkel.
Figure 7:
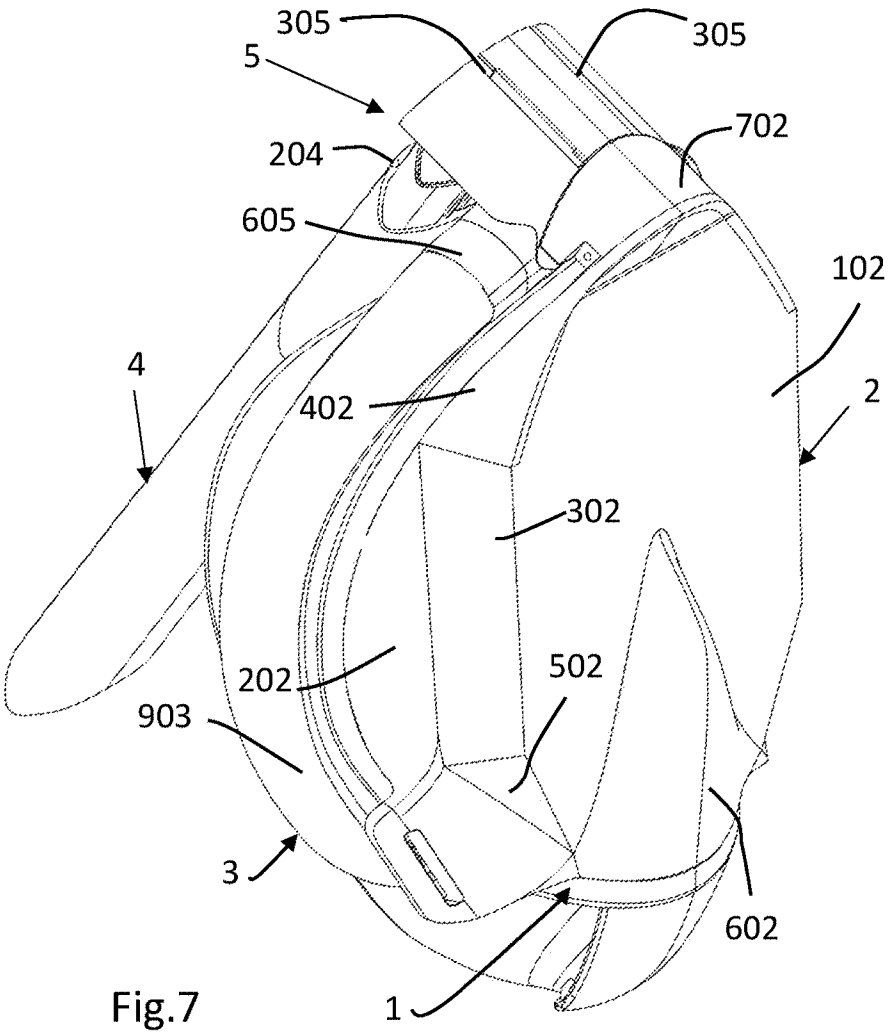
FIG. 7 shows a side view of the snorkel folded over on the back of the mask in resting position.
Figure 12:
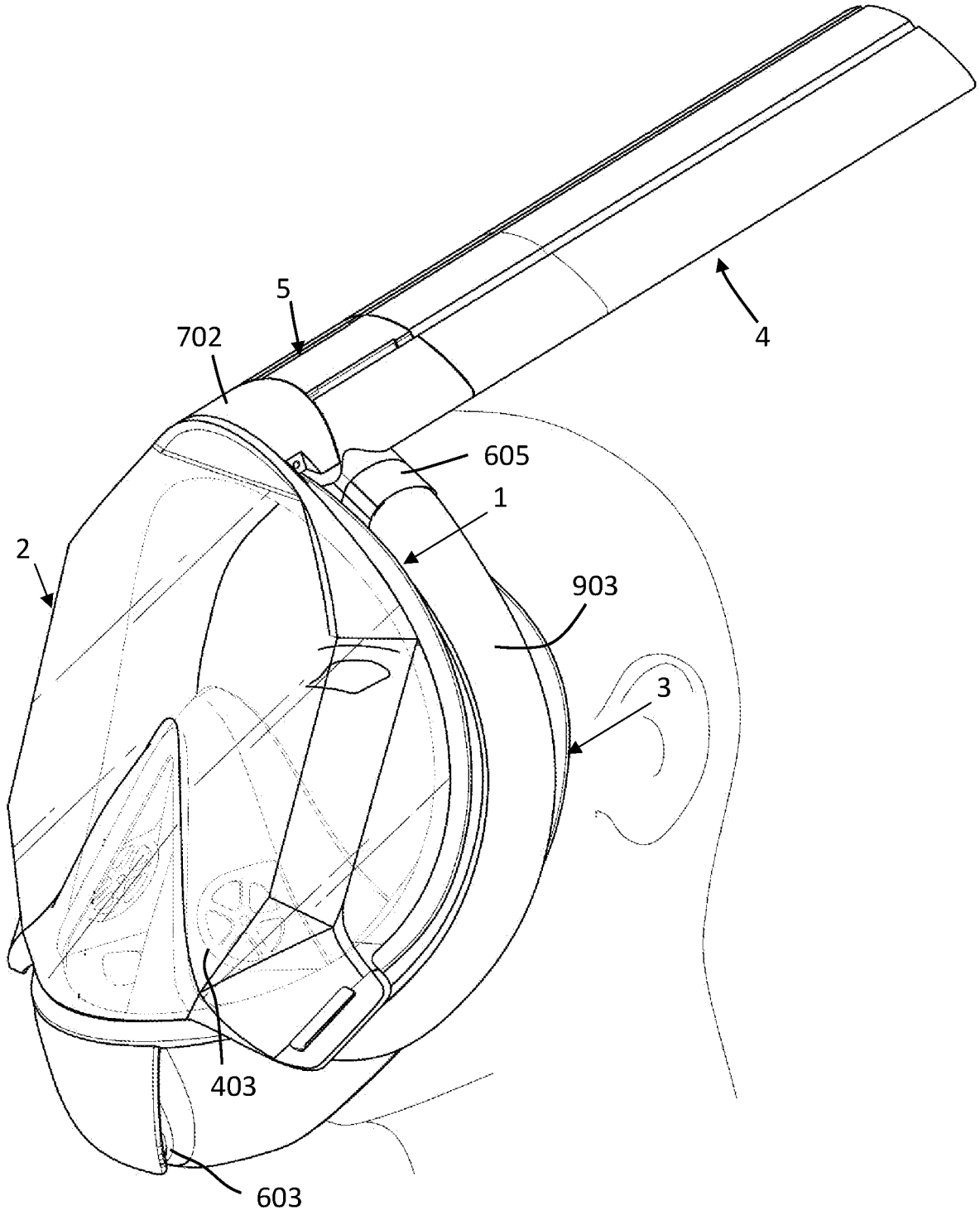
FIG. 12 shows the mask worn by a user.
Figure 13:
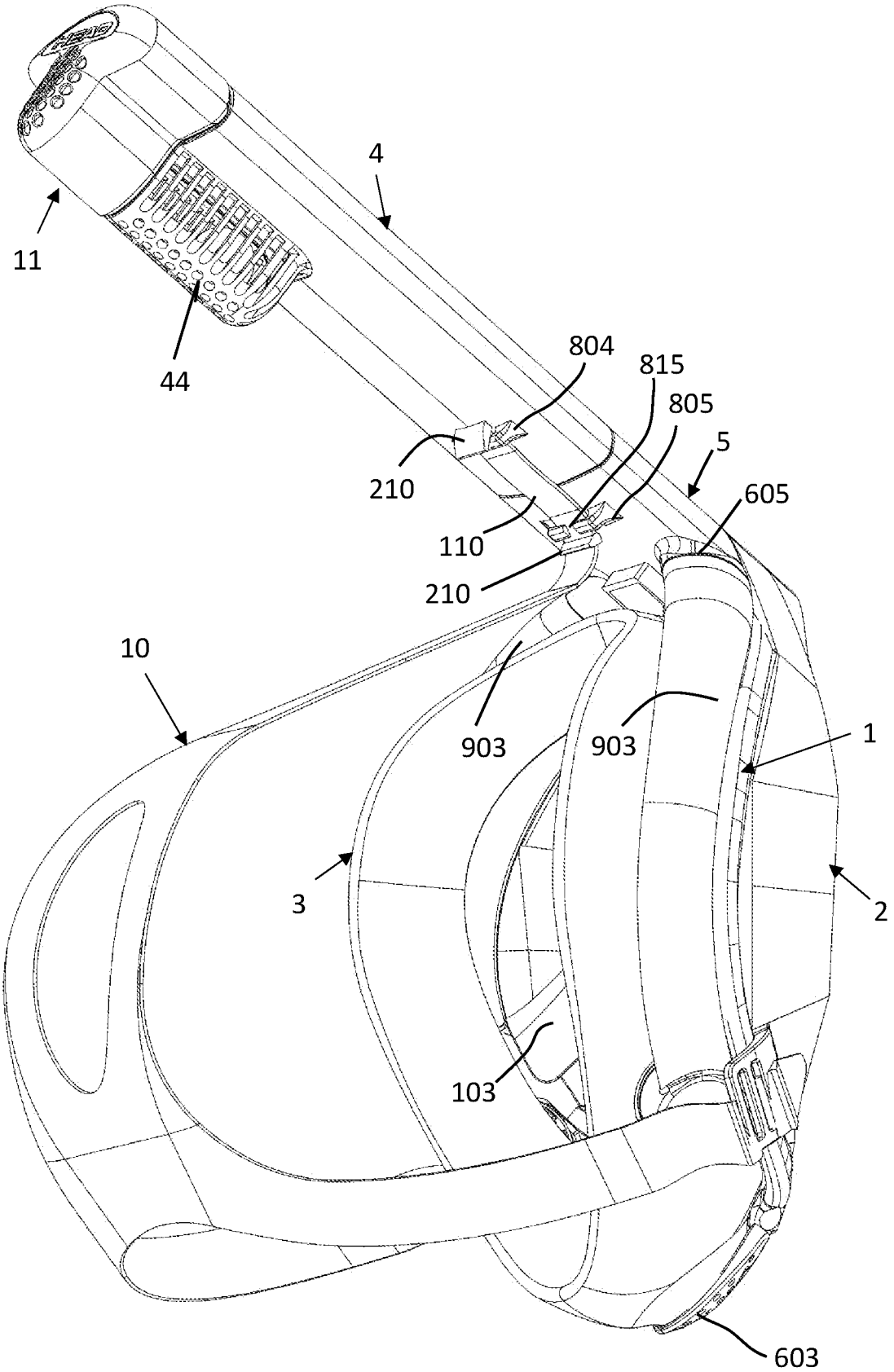
FIGS. 13 to 16 show different views along different directions of a further embodiment variation of the mask according to the present invention.
Figure 15:
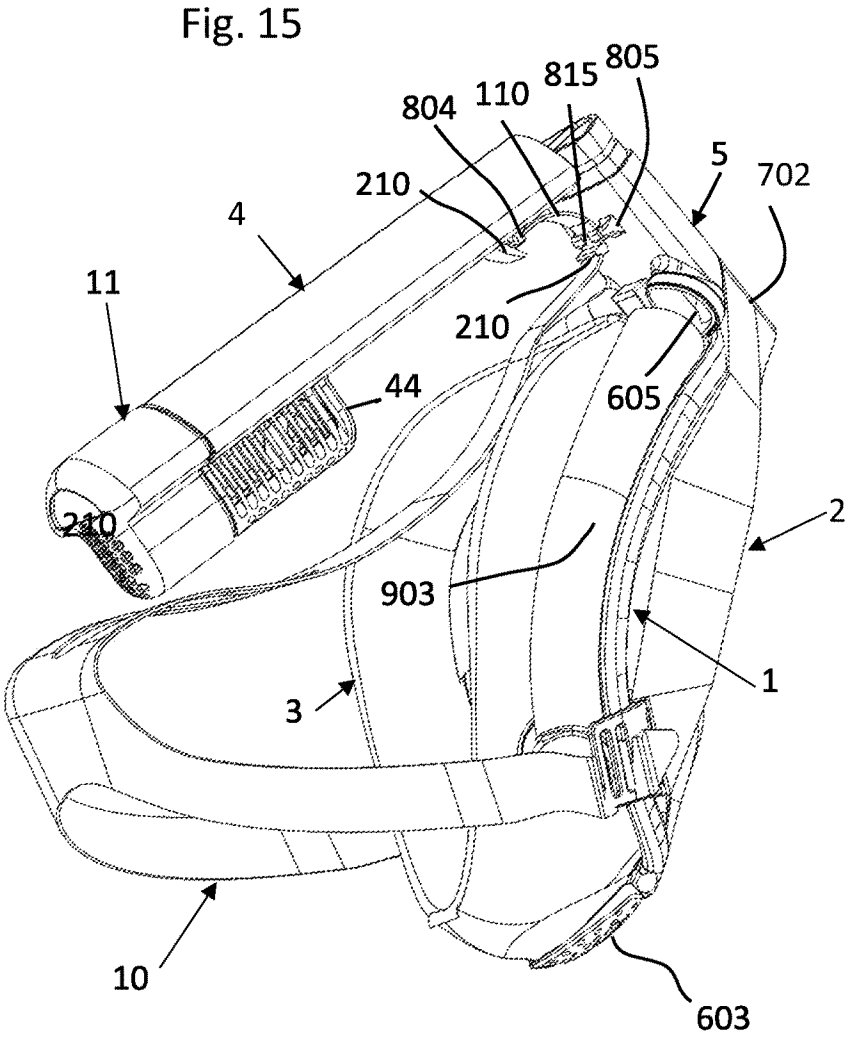
Figure 14:
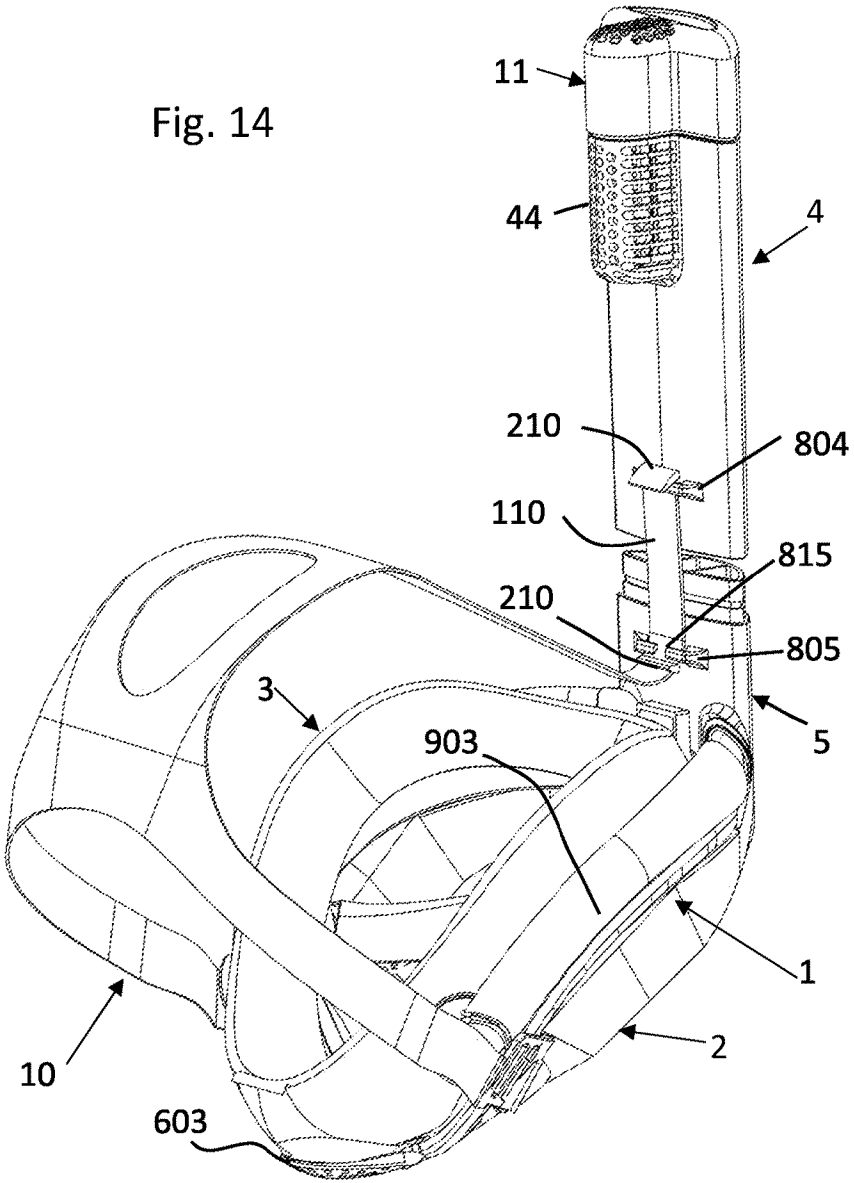
Figure 16:
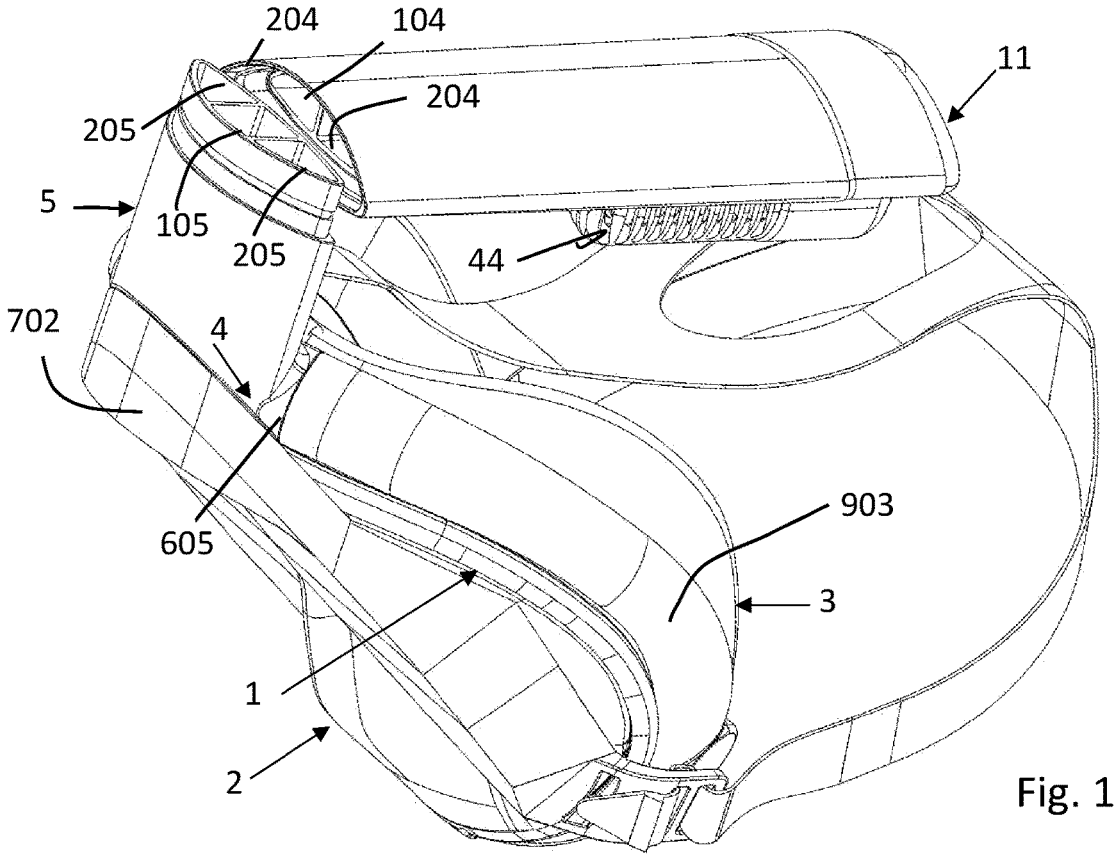

Thanks to this expedient the snorkel 4 can be inserted into the connection end 5 from the top, as shown in FIG. 5, until the button 404 of the tabs 304 abuts against the lower perimetrical edge 505. The snorkel 4 can, thus, be translated until reaching the position shown in FIG. 6, i.e. until bringing the button 404 in abutment against the side perimetrical edge 505. In this position the snorkel 4 can rotate in order to align the extensions of the central 104 and side 204 channels of the snorkel 4 to the corresponding central 105 and side 205 ducts of the connection end (see FIG. 11). An additional translation in the direction shown by the arrows results in a coupling of the snorkel 4 with the connection end 5 in the operating position (shown in FIG. 12).

Figure 8:
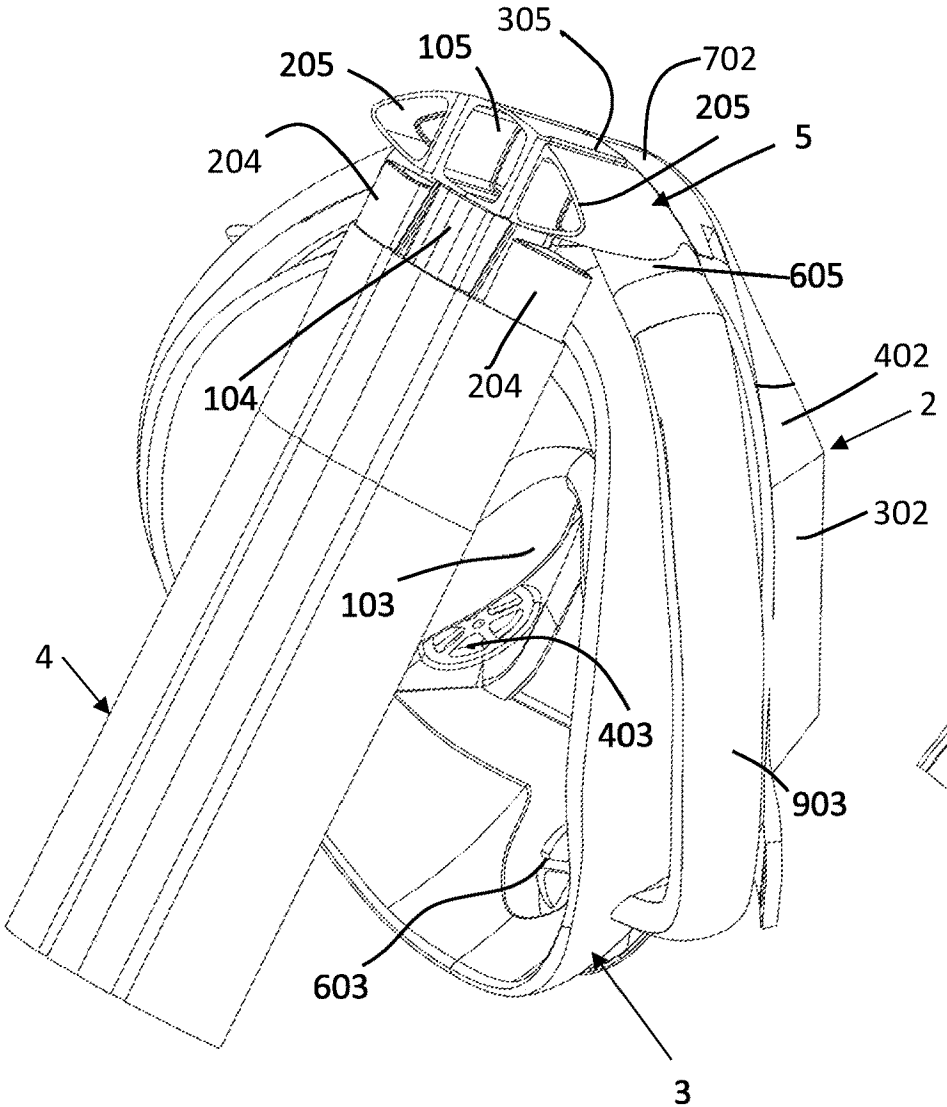
FIG. 8 shows an end view of the folded snorkel.
Figure 10:
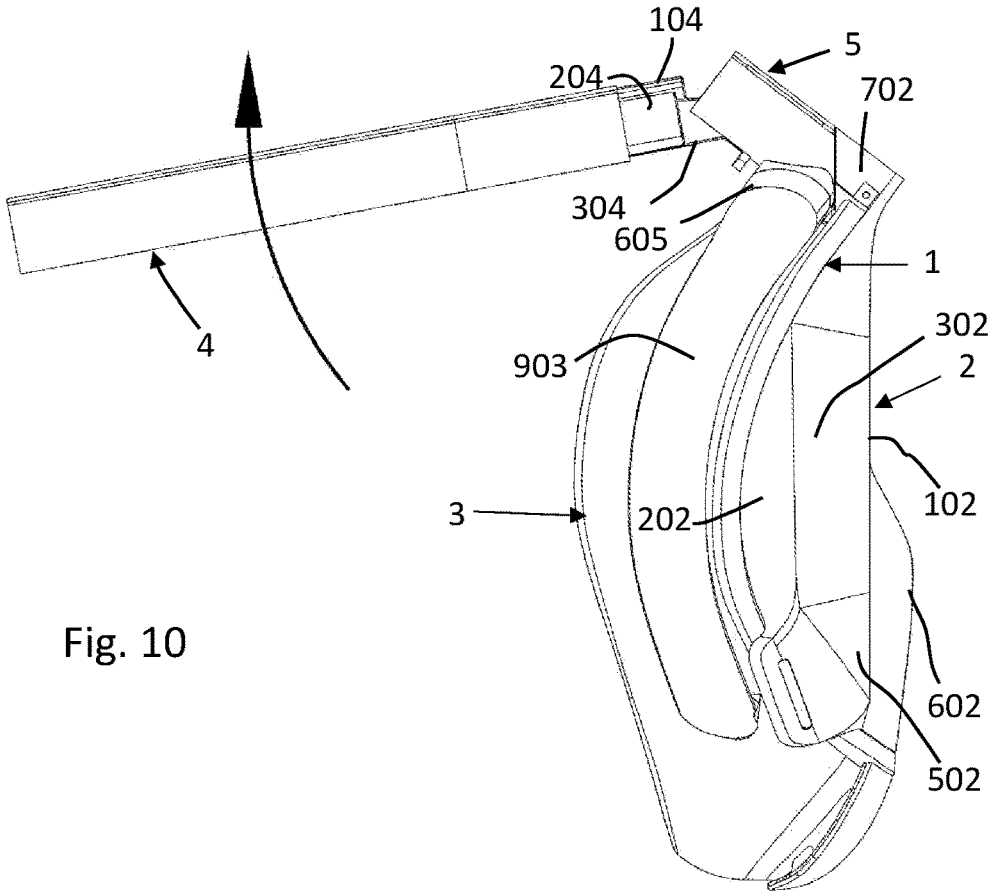
FIG. 10 shows a side section of the mask with the snorkel in intermediate position.
Figure 11:
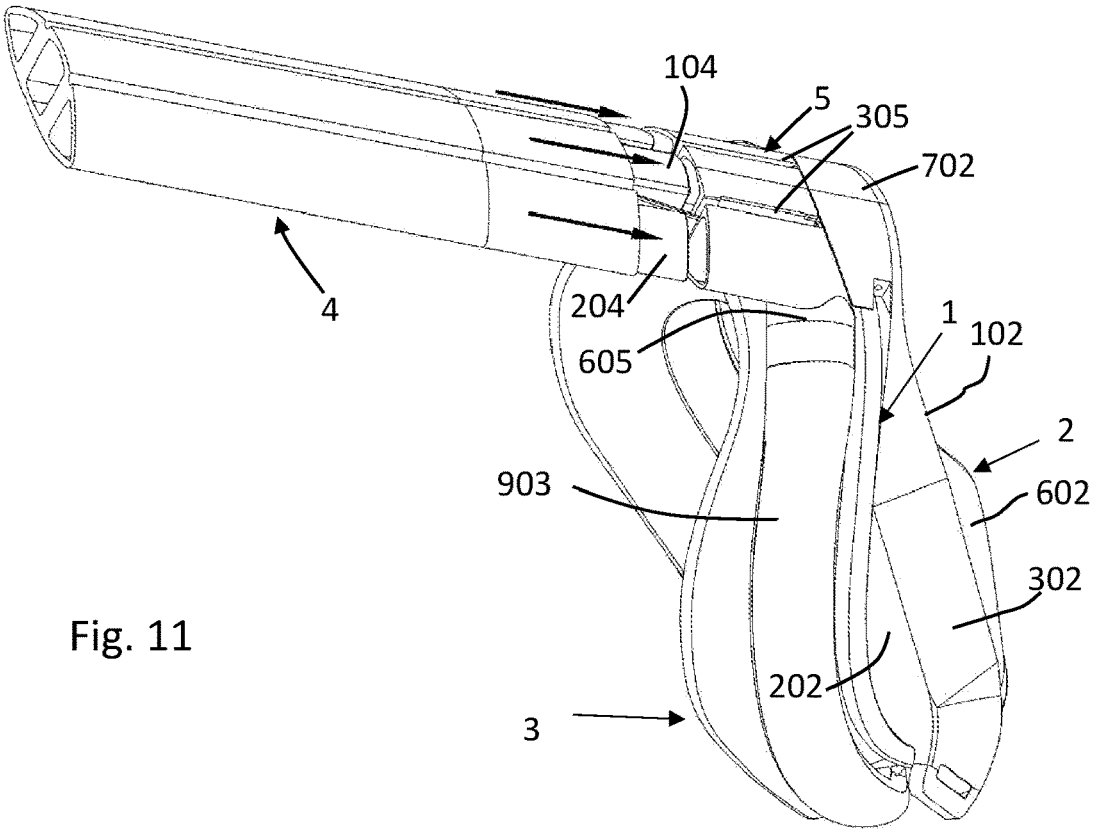
FIG. 11 shows the tube that has reached the angular operating position before its translation for the interlocking into the connection end.

The inclined resting position can be reached by making a translation in opposite direction such that the snorkel 4 is spaced out from the connection end 5. During this translation of the snorkel 4, the engaging end formed by the ends of the channels 204 and 104 is slipped off the ducts 105 and 205 of the connection end 5 having such a section to allow the ends of the channels 204, 104 to be inserted. In the disengaged position the snorkel is free with respect to a rotation with respect to the connection end 5, which allows bringing the snorkel 4 to be rested on the back of the mask as shown in FIG. 8.

It is apparent how the sliding travel of the tabs 304 between the two ends of the sliding guides consisting of the slits or gaps 305 is substantially corresponding to the engagement and disengagement travels of the ends of the channels 204 and 104 of the snorkel 4 into and from the ducts 105, 205 of the connection end 5.

By reverse operation, i.e. rotating in the opposite way and translating the tube in the coupling position with the connection end, the snorkel can be brought back to the operating position.

In practice the snorkel can be brought from an operating position to a resting position and vice versa thanks to the use of a combined translatory and rotary movement, wherein the translatory movement has the function of releasing the snorkel 4 from the connection end 5 albeit keeping it connected thereto, so as to prevent the accidental loss thereof.

An embodiment variation of the present invention can provide that the joint axis of the snorkel 4 to the connection end 5 has a different orientation, for example parallel to the sagittal plane and that therefore the swing of the snorkel 4 takes place laterally and not along the direction of the rear side of the mask.

FIGS. 13 to 19 show a further embodiment of the mask according to the present invention.

In FIGS. 13 to 19 the same reference numerals as in the example of FIGS. 1 to 12 will be used for the same portions or having the same function.

As it is apparent, the snorkel 4 is connected to the connection end 5 by means of a film hinge.

This consists of a tongue or a bridge of flexible and elastic material that is fastened with one of its two opposite ends respectively to the snorkel 4 and the connection end 5.

The material tongue 110 passes inside a loop 804 and 805 provided respectively on the rear or lower side of the snorkel 4 and the connection end 5, while a thickness widening 210 like a tooth or the like on the portion of said tongue 110 protruding beyond the side of the corresponding loop 804, 805 opposite the facing loop, respectively 805, 804 is provided.

The loops can have in the middle zone an opening 814, 815 for inserting the tongue and having a length slightly larger than the thickness of the tongue 110 and remarkably smaller than the width of said tongue, such as to allow the tongue to be inserted in said loops.

The tongue 110 can slide in the two loops 804, 805, but cannot slip off the same thanks to the thickenings 210.

Advantageously, the tongue is also elastically extensible to such an extent to ensure the slip-off travel of the ends of the channels 204, 104 of the snorkel 4 from the ducts 105, 205 of the connection end 5.

Advantageously, the distance of the loops 804, 805 and the position of the widenings 210 on the tongue 110 are such that, in the completely engaged condition of the ends of the channels 204, 104 into the corresponding ducts 105, 205, the tongue remains still tensioned in a predetermined degree such to generate a tension force along the engagement direction of the snorkel 4 into the connection end 5. This enables applying a force which permanently stresses said snorkel 4 in the operating position, i.e. in the condition of complete engagement into the connection end 5.

By suitably selecting the elastic characteristics of the tongue and the elongation conditions thereof in the two end positions of complete engagement of the snorkel 4 in the connection end 5 and of complete disengagement of the snorkel 4 from the connection end 5, a disengagement force to disengage the snorkel 4 from the connection end 5 can be applied manually, which force counters and overcomes the force applied by the tongue 110 along the engagement direction.

Once the snorkel 4 has been disengaged from the connection end 5, the tongue 110 reverts to the neutral condition wherein it is not restrained in an elongation position and only acts as connection of the snorkel 4 to the connection end 5, which connection allows a reciprocal swing of these parts.

As it is apparent from FIGS. 13 to 19, in an embodiment the tongue 110 is formed by the upper fastening end member of a fastening belt 10 to fasten the mask to the user's face, for example in the form of a fastening extension.

According to a further characteristic that can also be provided in the embodiment according to FIGS. 1 to 12, the snorkel 4 has, at the end opposite the frame 1 of the mask, i.e. the connection end 5, an end member 11 housing in its inside a float valve which closes at least the central channel 104 when the end of the snorkel 4, i.e. the end member 11 mounted on said end, takes a position with respect to the surface of water in which water can penetrate inside at least said channel 104.

A further characteristic that can be provided in combination with both the variations of the joint devices that are in the two embodiments of FIGS. 1 to 12 and 13 to 19 is the particular implementation of the exhaust tubes 903.

While in the embodiment according to FIGS. 1 to 12, the two exhaust tubes 903 branch off in a single piece from the seal part 3 and directly communicate with the lower chamber 303, in the embodiment of FIGS. 13 to 19, the exhaust tubes 903 are made as separate constructional parts that are removably connected with an end at an opening communicating with the lower chamber 303 and provided in the seal part 3, and with the other end at the connection end 5 similarly to the embodiment according to FIGS. 1 to 12.

The coupling takes place by a snap-fit interlocking coupling end member consisting of a ring provided with a crown of radial teeth provided at the ends with axial tongues elastically flexible in radial direction and which teeth and tongues engage with the edge delimiting an opening provided in the seal part 3.

According to still a further characteristic, between the end of the exhaust tube 903 and the opening in the seal part 3 a non-return valve with diaphragm plug is advantageously provided that is oriented such to not allow the return flow from the exhaust tube 903 to the lower chamber 303.

Different embodiment variations are possible, which can comprise a separate non-return valve consisting of an independent constructional part and mounted at said opening in the seal part 3.

The embodiment depicted shows a particularly advantageous embodiment variation, which provides the diaphragm plug 130 integrated with the wall of the seal part 3 at the through opening 30 and in communication with the lower chamber 303.

Figure 17:
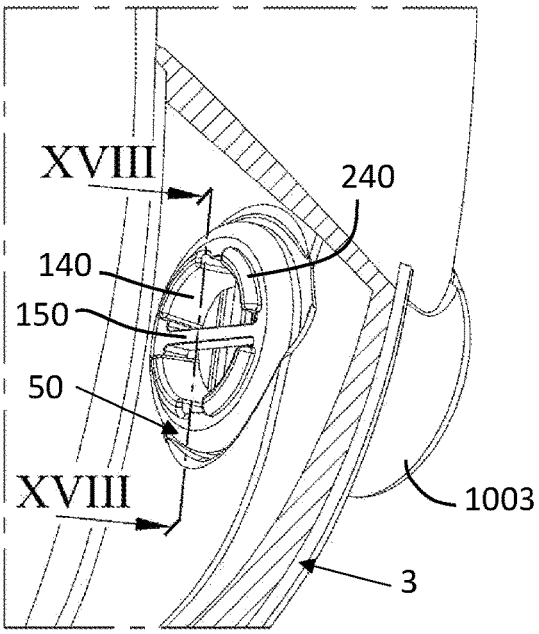
FIG. 17 shows a view of an enlarged detail of the mask according to FIGS. 13 to 16 in the zone of a non-return valve provided in the coupling zone of the exhaust tubes for ejecting the exhaled air and wherein the direction of view is from the inside of the mask outwards.
Figure 18:
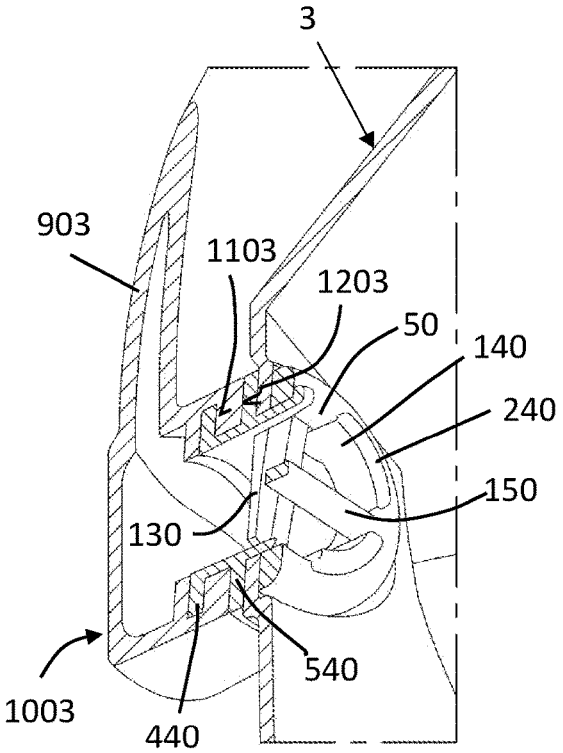
FIG. 18 shows a section of said detail along the section plane parallel to the passage axis of the valve and the line XVIII-XVIII of FIG. 17.
Figure 19:
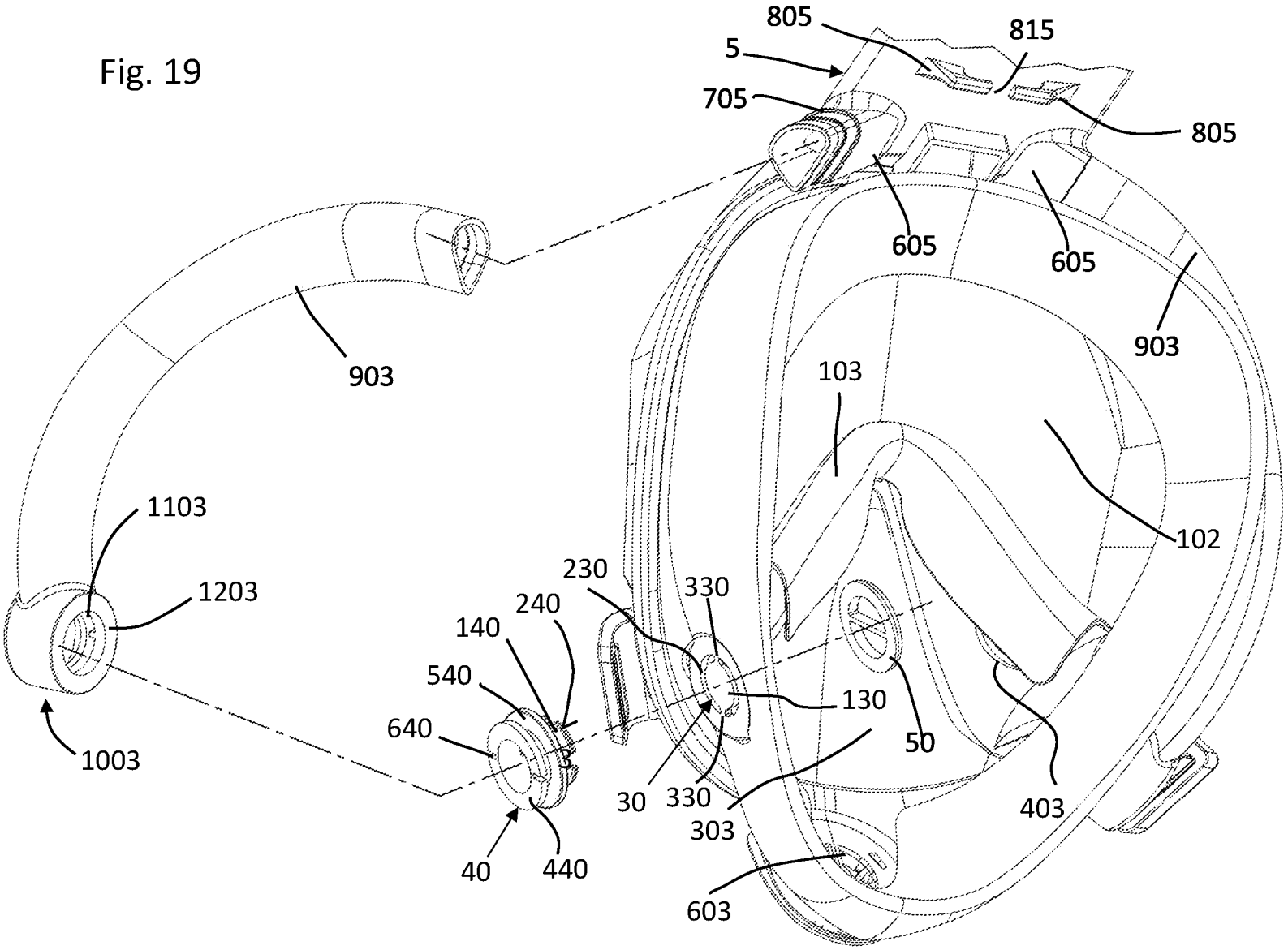
FIG. 19 shows a perspective view from the rear end of the mask, wherein a duct for ejecting the exhaled air is shown in an exploded view.

As it is apparent from FIGS. 17, 18 and 19, in the opening 30 a disk 130 is restrained in coaxial position, which disk is constituted by the same material as the seal part 3. The disk 130 has a diameter smaller than the diameter of the opening 30 and forms an annular slit 230 with the edge thereof. The disk 130 is restrained in a centered position with respect to the opening 30 thanks to two material bridges 330 reciprocally diametrically opposite.

A locking bushing of rigid material having a predetermined elasticity denoted by 40 forms a snap-fit coupling fastening end member of the end of the exhaust tube 903 to the seal part 3 in the zone of said opening 30.

In particular, said bushing 40 forms at the same time the fastening element of a valve seat 50 cooperating with the diaphragm plug 130 to the seal part 3. The valve seat 50 consists of a ring restrained in position against the diaphragm plug 130 by the locking bushing 40. This has, on the side facing towards the seal part 3, a crown of flexible axial tongues 140 having external radial teeth 240 at their ends. The tongues are arranged along a circumference line having such a radius and have such an axial length that, in assembled condition, they penetrate through the slit 230 between diaphragm plug 130 and edge of the opening 30 and overlap with the end teeth 240 on the side of the ring forming the valve seat 50 facing the inside of the lower chamber 303.

The axial length of the flexible tongues 140, compared to the overall thickness of the wall of the seal part 3 at the opening 30 and the ring constituting the valve seat 50, is such that the bushing 40 and the ring constituting the valve seat 50 are sealingly tightened against the wall of the seal part 3 at the region surrounding said opening 30.

According to a possible further characteristic, the ring constituting the valve seat 50 can further have a central diametrical rib 150 forming an intermediate support for the two halves of the disk constituting the diaphragm plug 130, said rib 150 being oriented transversally to the diametrical axis along which the material bridges 330 that fasten the disk to the edge of the opening 30 are aligned.

The locking bushing 40 can be made in a single piece or permanently fastened to the end of the exhaust tube 903, or said bushing 40 can be sealingly fixable by interlocked coupling or by shape coupling or by elastic force fit. The coupling is sealingly made between the exhaust tube 903 and the locking bushing 40.

An embodiment of this last variation is depicted in FIG. 19. In this case, the bushing 40 has on the side for coupling with an interlocking seat 1003, at the end of the exhaust tube 903, an annular flange 440 forming an outer radial tab intended to be engaged by elastic forcing into a corresponding annular inner throat 1103 provided in the end of the tube 903. The throat 1103 is provided at such a distance from the head side of the end of the exhaust tube 903, corresponding to the distance of the annular flange 440 from an annular countercheck surface 540, that in the condition wherein the locking bushing 40 is coupled to the end of the exhaust tube 903, the head side 1203 of said end is sealingly compressed against the annular countercheck surface 540 and possibly further by tightening the wall of the tubular length between the throat 1103 and the head side 1203 at the end of the tube 903 sealingly against the tubular length connecting the annular flange 440 to the annular countercheck 540.

Still according to a further characteristic, the annular flange 440 has at least one radial notch 640 in which a radial rib provided in the annular throat 1103 for engaging said annular flange 440 is engaged.

As it is apparent, the different embodiments of the joint of the snorkel to the mask and the different embodiment variations of the exhaust tubes 903 can be provided in any reciprocal combination and in particular the embodiment of the joint according to FIGS. 1 to 12 can be provided in combination with the embodiment variations of the coupling of the exhaust tubes 903 to the seal part 3 according to the FIGS. 13 to 19 and the embodiments of the joint of the snorkel according to the FIGS. 13 to 19 can be provided in combination with the embodiment variation of the exhaust tubes according to the FIGS. 1 to 12.

Figure 20:
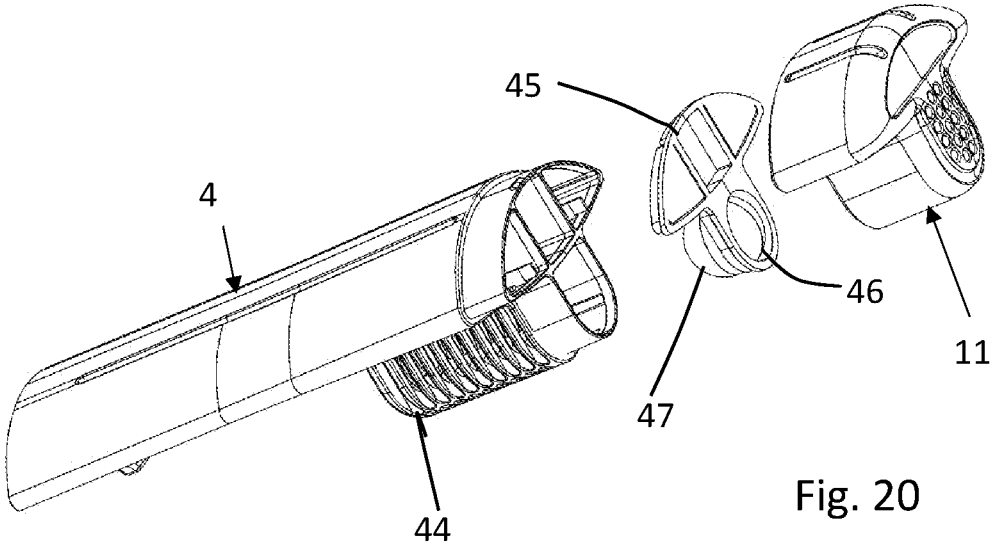
FIGS. 20 and 21 show a sectional view and a perspective exploded view of the snorkel and the connection end thereon.
Figure 21:
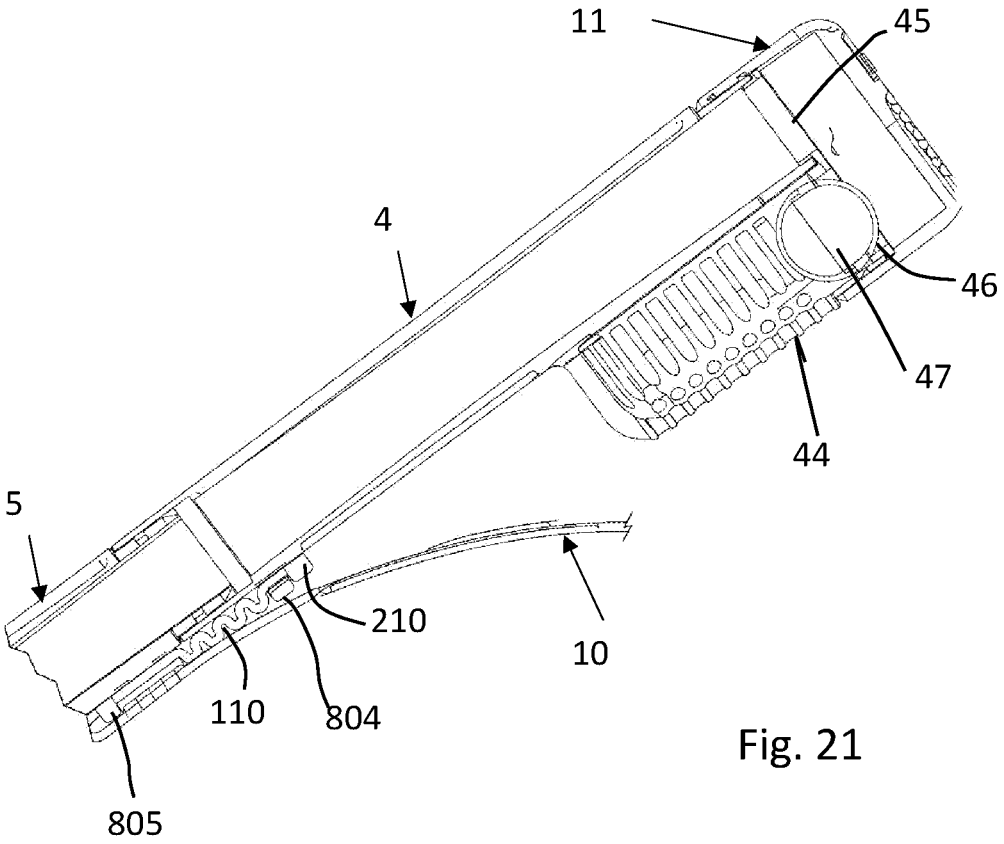

FIGS. 20 and 21 show an embodiment of the valve at the end of the snorkel, which valve can be provided in combination with any of the preceding embodiments.

In addition, FIGS. 20 and 21 also show an embodiment variation of the joint which is implemented according to the principle of the preceding embodiment of FIGS. 13 to 19, this variation or that of FIGS. 13 to 19 being suitable to be adopted indifferently in the two snorkel embodiments.

As regard to the end member 11 on the snorkel 4, an embodiment provides that along an ending length of a predetermined length of the snorkel 4, a tubular length 44 is provided and has a pierced or grid wall and generates an additional duct.

The duct forms a housing cage for a float 47, in particular with the shape of a sphere, allowing its displacement along the longitudinal axis of said tubular length 44, in this case upon the water force at immersion. The duct is positioned with respect to the snorkel 4 such as to provide the assembly with a substantially T-shaped cross section, wherein the leg of the T consists of said tubular length 44. The tubular length is closed by the pierced wall at the end facing the mask, whereas it is open at the end facing the end member 11.

The end member 11 has a cross section having a shape substantially corresponding to the T one of the ending length of the snorkel with the tubular length 44 and axially extends said assembly up to a head wall closed in the region coincident with the port of the snorkel 4 and pierced at the port of the length 44.

The end member 11 has a cross section having a shape substantially corresponding to the T one of the ending length of the snorkel with the tubular segment 44 and axially extends said assembly up to a head wall closed to the outside.

The end member 44 is permanently or removably sealingly fastened, for example by sealingly fitting onto an engagement end extension of the snorkel 4 and the tubular length 44. Between the end member 11 and the port of the snorkel 4 and length 44 an element 45 is provided and forms a diaphragm plug acting as a non-return valve, which is configured such as to prevent a return flow to the exhaust ducts of the snorkel 4. An appendix 46 coinciding with the port of the tubular length 44 forms a valve seat like an annular seal part, which is intended to cooperate with the plug consisting of the spherical float 47.

When the tube is immersed, the water pushes the float 47 towards the end member 11 and along the direction of the annular seat 46 with which there is a contact, closing the passage of water towards the inside of the snorkel 4. In the condition in which the float 47 is not immersed, the weight of the float 47 moves it away by gravity from the valve seat 46 in the opening condition of the snorkel 4.

In connection with what above, it is relevant that the floating 47, plug 45 and valve seat 46 assembly is made as an integral constructional piece having a cross section with shape substantially the same as that of the snorkel 4 and end length 44 assembly and with sizes suitable to be restrained in position between the end member 11 and the end of said snorkel 4.

In an embodiment, the valve seat can be in form of an O-ring with a mantle surface with a circular cross section, at least for a part of the mantle surface facing the inside of said annular valve.

According to an additional characteristic which does not need to be necessarily provided in combination with the characteristics described in reference to the snorkel 4, at the end member 47 and the members 45 to 47, but that can also be provided in combination with any of the preceding embodiments of the mask, the tongue 110 forming the film hinge between the snorkel 4 and the mask, i.e. the connection end 5, has in the length comprised between the loop 804 on the snorkel 4 and the loop 805 on the connection end 5, a wavy length 500 increasing the elastic flexibility in relation to curvatures along axes parallel to the faces of the tongue 110 and perpendicular to the longitudinal extension thereof and increasing the elastic extensibility thereof.

In the example the length 500 is wavy like a sinusoid, but it can also be zigzag or fret shaped or the like.

Although the description mostly refers to a mask with double channel for ejecting the air, the teachings of the present invention can also be applied in simpler masks providing the use of a single duct for the exhaled air both at the snorkel level and the duct conveying the air from the lower chamber to the snorkel. All without departing from the afore stated guiding principle and claimed as follows.

The invention claimed is:

1. A mask comprising:

a frame (1);

a transparent part (2) supported by the frame;

a seal part (3) mounted on the frame (1) and adapted to be placed on a user's face, the seal part (3) comprising a partition wall (103) adapted to rest on a user's nose with the mask in a worn condition to form an upper chamber (203) and a lower chamber (303) sealingly separated from each other and with the lower chamber receiving the user's nose and mouth, wherein the upper and the lower chambers are in communication through a passage provided in the partition wall (103) and a one-way valve (403) that enable air to pass from the upper chamber (203) to the lower chamber (303) and not vice versa; and a snorkel (4) comprising at least one first and one second channel (104, 204) that put in communication the upper chamber (203) and respectively the lower chamber (303) with an external environment, and wherein the snorkel (4) has a connection end (5) providing a connection to the mask, the connection end (5) being fastened or fastenable at an opening of the seal part (3) to put in communication the first channel (104) of the snorkel (4) with the upper chamber (203) of the mask, the connection end (5) having at least one side inlet for a corresponding exhaust tube (903), the exhaust tube (903) putting the lower chamber (303) in communication with the second channel (204) of the snorkel (4), wherein the exhaust tube (903) runs outside of the mask in proximity of a side edge of the seal part (3), and wherein the exhaust tube (903) is made as a separate building part and is firmly or removably connectable to a communication opening (30) of the seal part (3).

2. The mask according to claim 1, wherein, at least along part of side edges of the frame (1) and of the seal part (3), said frame (1) and said seal part (3) form a channel with a V shaped cross-section, with a closed vertex facing a central region of the mask, and wherein the exhaust tube (903) has a V shaped section which is shaped and sized correspondingly to a section and a size of said channel, said exhaust tube (903) being housed in said channel in a mounted condition and a wall thereof, on a side opposite to the central region of the mask, forms a wall connecting a surface of the frame (1) and of the seal part (3) on a same side opposite the central region of the mask.

3. The mask according to claim 1, wherein the connection end (5) has a pair of side openings with connection branches (605) oriented in directions opposite to each other with respect to a center of the mask, each of the connection branches being adapted to connect with the exhaust tube (903) that puts the lower chamber (303) in communication with the second channel (204) of the snorkel (4).

4. The mask according to claim 1, wherein the connection end (5) comprises a central duct (105) and two side ducts (205), extensions of the central channel (104) and side channels (204) of the snorkel (4) being fitted in the central and side ducts, and wherein an opposite end of the connection end (5) is closed and has tabs (405) for engagement with corresponding tabs (101) present on the frame (1), the tabs (101) being restrained in place by a coupling surface (702) present on the transparent part (2) when the mask is assembled, the two side channels (205) being each coupled with a corresponding tube (903), the exhaust tubes (903) putting the lower chamber (303) in communication with the side channels (204) of the snorkel (4) through the side ducts (205) of said connection end (5).

5. The mask according to claim 1, wherein there are provided two exhaust tubes (903) arranged on opposite sides of the mask that lead in the lower chamber (303) in opposite positions with respect to a longitudinal median line of the mask.

6. The mask according to claim 5, wherein the exhaust tubes (903) run along opposite surfaces following a profile of the seal part (3) that delimits the upper chamber (203).

7. The mask according to claim 1, wherein the exhaust tube (903) is firmly fastened to the seal part (3) at the communication opening (30) in communication with the lower chamber (303).

8. The mask according to claim 7, wherein the exhaust tube (903) is provided as one piece.

9. The mask according to claim 1, wherein the exhaust tube (903) is sealingly fastenable to the seal part (3) at the communication opening (30) communicating with the lower chamber (303).

10. The mask according to claim 9, wherein an end of the exhaust tube (903) is provided with a connection end connecting to the communication opening (30) by interlocking coupling, shape coupling, or elastic forcing on a cooperating connection to the seal part (3).

11. The mask according to claim 10, further comprising an element (40) sealingly and removably fastening the connection end of the exhaust tube (903) to the communication opening (30) of the seal part (3), said element (40) being a separate building part adapted to be interposed between said connection end of said the exhaust tube (903) and a corresponding communication opening (30), wherein said element (40) has fastening members (140, 240, 340, 440, 540) firmly or releasably fastening, on one side, to corresponding members (1103) on the connection end of the exhaust tube (903), and on another side, to a wall delimiting said communication opening (30).

12. The mask according to claim 11, further comprising a non-return valve oriented to enable flowing from the lower chamber (303) to an outer environment and to prevent flowing in an opposite direction.

13. The mask according to claim 12, wherein said non-return valve (50) is provided at the communication opening (30).

14. The mask according to claim 13, wherein said non-return valve (50) is integrated within an end connecting the end of the exhaust tube (903) to a corresponding communication opening (30) communicating with the lower chamber (303).

15. The mask according to claim 12, wherein the non-return valve (50) has a diaphragm plug (130) made as one piece with the seal part (3) and held in place perpendicular to an axis or to a passage direction in a port of the communication opening (30) by material bridges (330), and wherein the fastening members (140, 240, 340, 440, 540) are composed of members sealingly clamping a valve annular seat (50) and an abutment annular wall overlapping opposite faces of a wall strip surrounding said communication opening (30) and also a peripheral strip of the diaphragm plug (130).

16. The mask according to claim 1, wherein the connection end (5) is connected to the snorkel (4) by an articulation that has a coupling position, and wherein the connection end (5) and the snorkel (4) are fixed in an operating position and a release position of the connection end (5) where the snorkel (4) remains connected to the connection end (5), but it is free to swing.

17. The mask according to claim 1, wherein the transparent part (2) has a polygonal shape with connecting squared faces.

18. The mask according to claim 1, wherein the transparent part (2) is divided in a central raised part (102) with a planar development and polygonal shape, connected to a perimetric region (202), adapted to be coupled to the frame (1), through inclined polygonal shaped surfaces (302, 402, 502).

19. A mask comprising:

a frame (1);

a transparent part (2) supported by the frame;

a seal part (3) mounted on the frame (1) and adapted to be placed on a user's face, the seal part (3) comprising a partition wall (103) adapted to rest on a user's nose with the mask in a worn condition to form an upper chamber (203) and a lower chamber (303) sealingly separated from each other and with the lower chamber receiving the user's nose and mouth, wherein the upper and the lower chambers are in communication through a passage provided in the partition wall (103) and a one-way valve (403) that enable air to pass from the upper chamber (203) to the lower chamber (303) and not vice versa; and a snorkel (4) comprising at least one first and one second channel (104, 204) that put in communication the upper chamber (203) and respectively the lower chamber (303) with an external environment, further comprising a non-return valve for an air flow from the lower chamber to the second channel (204) in communication with the external environment, the non-return valve being oriented to allow flowing from the lower chamber to the external environment and to prevent flowing, from the external environment to the lower chamber, a flow to the external environment and an exhaust flow of air exhaled by the user in the lower chamber, and wherein the snorkel (4) has a connection end (5) providing a connection to the mask, the connection end (5) being fastened or fastenable at an opening of the seal part (3) to put in communication the first channel (104) of the snorkel (4) with the upper chamber (203) of the mask, the connection end (5) having at least one side inlet for a corresponding exhaust tube (903), the exhaust tube (903) putting the lower chamber (303) in communication with the second channel (204) of the snorkel (4), wherein the exhaust tube (903) runs outside of the mask in proximity of a side edge of the seal part (3), and wherein the exhaust tube (903) is made as a separate building part and is firmly or removably connectable to a communication opening (30) of the seal part (3).

* * * * *